US008411007B2

(12) United States Patent
Chen et al.

(10) Patent No.: US 8,411,007 B2
(45) Date of Patent: Apr. 2, 2013

(54) LCD DISPLAY VISUAL ENHANCEMENT DRIVING CIRCUIT AND METHOD

(75) Inventors: Yung-Chih Chen, Hsinchu (TW); Yu-Chung Yang, Hsinchu (TW); Kun-Yueh Lin, Hsinchu (TW); Chun-Hsin Liu, Hsinchu (TW)

(73) Assignee: AU Optronics Corporation, Hsinchu (TW)

( * ) Notice: Subject to any disclaimer, the term of this patent is extended or adjusted under 35 U.S.C. 154(b) by 336 days.

(21) Appl. No.: 12/660,315

(22) Filed: Feb. 23, 2010

(65) Prior Publication Data

US 2011/0205461 A1 Aug. 25, 2011

(51) Int. Cl.
*G09G 3/36* (2006.01)

(52) U.S. Cl. ..... 345/92; 345/204; 345/94; 349/38

(58) Field of Classification Search ..... 349/38; 345/87–104, 204, 690
See application file for complete search history.

(56) References Cited

U.S. PATENT DOCUMENTS

| | | | | |
|---|---|---|---|---|
| 7,206,048 | B2 | 4/2007 | Song | |
| 7,283,192 | B2 | 10/2007 | Shimoshikiryo | |
| 7,327,168 | B2 | 2/2008 | Kimura | |
| 7,548,285 | B2 | 6/2009 | Su et al. | |
| 7,843,520 | B2 | 11/2010 | Lu et al. | |
| 7,965,106 | B2 | 6/2011 | Kimura | |
| 2006/0139280 | A1 | 6/2006 | Su et al. | |
| 2007/0064164 | A1 | 3/2007 | Tasaka et al. | |
| 2008/0055292 | A1 | 3/2008 | Do et al. | |
| 2008/0277707 | A1* | 11/2008 | Kimura | 257/296 |
| 2008/0303768 | A1* | 12/2008 | Do et al. | 345/90 |
| 2009/0027325 | A1 | 1/2009 | Kim et al. | |
| 2009/0027581 | A1 | 1/2009 | You et al. | |
| 2009/0078972 | A1 | 3/2009 | Hwang et al. | |
| 2009/0268112 | A1* | 10/2009 | Lu et al. | 349/38 |
| 2009/0290677 | A1* | 11/2009 | Otose et al. | 377/78 |
| 2010/0007594 | A1 | 1/2010 | Lai et al. | |
| 2010/0157185 | A1* | 6/2010 | Kim et al. | 349/38 |
| 2011/0248746 | A1 | 10/2011 | Kimura | |

FOREIGN PATENT DOCUMENTS

| | | |
|---|---|---|
| CN | 1503452 | 6/2004 |
| CN | 101566771 | 10/2009 |
| CN | 101594135 | 12/2009 |

* cited by examiner

*Primary Examiner* — Stephen Sherman

(57) ABSTRACT

A pixel in a liquid crystal display panel comprises a first sub-pixel area having a first sub-pixel electrode and a second sub-pixel area having a second sub-pixel electrode. Each sub-pixel electrode is associated with a capacitor. When a gate-line signal and a data voltage is provided to the pixel, the voltage level on the first sub-pixel electrode is substantially equal to or slightly higher than the voltage level on the second sub-pixel electrode and the capacitor associated with each sub-pixel electrode is charged. When the gate-line signal has entirely passed on partially passed, a circuit element causes the capacitor associated with the second sub-pixel electrode to transfer its charge to another capacitor, resulting in a reduction of the voltage level on the second sub-pixel electrode.

15 Claims, 10 Drawing Sheets

LCD DISPLAY VISUAL ENHANCEMENT DRIVING CIRCUIT AND METHOD

BACKGROUND OF THE INVENTION

The present invention relates generally to a liquid crystal display (LCD) display and, more particularly, to a method for driving the pixels in an LCD display.

BACKGROUND OF THE INVENTION

A typical liquid crystal display (LCD) panel has a plurality of pixels arranged in a two-dimensional array, driven by a data driver and a gate driver. As shown in FIG. 1, the LCD pixels 10 in a LCD panel 1 are arranged in rows and columns in a display area 100. A data driver 200 is used to provide a signal indicative of data to each of the columns and a gate driver is used to provide a gate line signal to each of the rows. In a color LCD panel, an image is generally presented in three colors: red (R), green (G) and blue (B). Each of the pixels 10 is typically divided into three color sub-pixels: red sub-pixel 20R, green sub-pixel 20G and blue sub-pixel 20B, as shown in FIG. 2. A data line 221 is used to provide the data signal to the R sub-pixel in a column, a data line 222 is used to provide the data signal to the G sub-pixel in the same pixel column, and a data line 223 is used to provide the data signal to the B sub-pixel in the same pixel column. The data line 224 is used to provide the data signal to the R sub-pixel in the next pixel column. A gate line 231 is used to provide the gate line signal to all sub-pixels in a row and a gate line 232 is used to provide the gate line signal to all sub-pixels in the next row. In a transflective LCD panel, each of the color sub-pixels may be further divided into a transmissive area and a reflective area.

A typical LCD panel is fabricated with two substrates. As shown in FIG. 3, the LCD panel has an upper substrate 12 and a lower substrate 18 and a liquid crystal layer disposed between the substrates. On the upper substrate 12, a transparent, electrically conducting layer 14 is provided as a common electrode. In each of the color sub-pixels 20, an electrically conducting layer is disposed on the lower substrate 18 as a pixel electrode. The LCD panel also comprises an electronic component layer 17 for controlling the voltage between the common electrode and the pixel electrode. The common electrode is usually connected to a common ground or a common voltage source COM.

SUMMARY OF THE INVENTION

A pixel in a liquid crystal display panel, according to various embodiments of the present invention, comprises a first sub-pixel area having a first sub-pixel electrode (32) and a second sub-pixel area having a second sub-pixel electrode (34). Each sub-pixel electrode is associated with a capacitor. When a gate-line signal and a data voltage is provided to the pixel, the voltage level on the first sub-pixel electrode is substantially equal to or slightly higher than the voltage level on the second sub-pixel electrode and the capacitor associated with each sub-pixel electrode is charged. When the gate-line signal has entirely passed on partially passed, a circuit element causes the capacitor associated with the second sub-pixel electrode to transfer its charge to another capacitor, resulting in a reduction of the voltage level on the second sub-pixel electrode. As such, the alignment of the liquid crystal molecules in the first sub-pixel area is slightly different from the alignment of the liquid crystal molecules in the second sub-pixel area, resulting in a slight brightness difference between the first and the second sub-pixel areas. This brightness difference may reduce the color shift of the liquid crystal display panel.

Thus, the first aspect of the present invention is a liquid crystal display panel, comprising:

a plurality of pixels arranged in a plurality of rows and columns;

a plurality of data lines, each for providing date signals to the pixels in a column, and a plurality of gate-lines, each for proving gate-line signals to the pixels in a row, wherein each of some or all of the pixels comprises:

a first sub-pixel area comprising a first sub-pixel electrode (32) electrically connected to a first capacitor (ClcA, CstA), the first sub-pixel electrode arranged to receive the data signal from one of the data lines via a first switching element (132); and a second sub-pixel area comprises a second sub-pixel electrode (34) electrically connected to a second capacitor (ClcB) and a first capacitor end of a third capacitor (CstB), the second sub-pixel electrode arranged to receive said data signal from said one of the data lines via a second switching element (134), wherein a second capacitor end of the third capacitor (CstB) is connected to said one of the data lines via a third switching element (136), wherein each of the first, second and third switching elements comprises a control end arranged to receive a first gate-line signal for charging the first capacitor (ClcA, CstA) and the second capacitor (ClcB), and wherein the second capacitor end of the third capacitor (CstB) is connected to a circuit element (Cx, 138, R, 139) such that when the first gate-line signal has at least partially passed, part of electrical charge on the second capacitor (ClcB) is transferred to the third capacitor (CstB).

In one embodiment of the present invention (FIG. 8), one end of the first and second capacitors is connected to a common voltage (COM), and the circuit element comprises a fourth switching element (138) having a control end arranged to receive a second gate-line signal for connecting the second end of the third capacitor (CstB) to the common voltage after the first gate-line signal has passed.

In another embodiment of the present invention (FIG. 5), one end of the first and second capacitors is connected to a common voltage (COM), and the second end of the third capacitor (CstB) is also connected to the common voltage via a fourth capacitor (Cx).

In yet another embodiment of the present invention (FIG. 11), the second capacitor (ClcB) is connected to a fifth capacitor (CstB) in parallel.

In a different embodiment of the present invention (FIG. 9), one end of the first and second capacitors is connected to a common voltage (COM), and the circuit element comprises a resistor (R) connected to the common voltage.

In another embodiment of the present invention (FIG. 10), the circuit element comprises a TFT with a diode connection.

In still another embodiment of the present invention (FIG. 12*b*), one end of the first and second capacitors is connected to a common voltage (COM), and the circuit element comprises a sixth capacitor (Cs) connected to the common voltage via a fourth switching element (138) having a control end arranged to receive a second gate-line signal for connecting the second end of the third capacitor (CstB) to the common voltage via the sixth capacitor (Cs) after the first gate-line signal has partially passed.

In yet another embodiment of the present invention (FIG. 12*a*), one end of the first and second capacitors is connected to a common voltage (COM), the second end of the third capacitor (CstB) is connected to the third switching element (136) via a sixth capacitor (Cs) and the circuit element comprises a fourth switching element (138) having a control end arranged to receive a second gate-line signal for connecting the second end of the third capacitor (CstB) to the common voltage after the first gate-line signal has partially passed.

The second aspect of the present invention is a method for charge sharing in a liquid crystal display panel, the display panel comprising:

a plurality of pixels arranged in a plurality of rows and columns;

a plurality of data lines, each for providing date signals to the pixels in a column, and a plurality of gate-lines, each for proving gate-line signals to the pixels in a row, wherein each of some or all of the pixels comprises:

a first sub-pixel area comprising a first sub-pixel electrode (32) electrically connected to a first capacitor (ClcA, CstA), the first sub-pixel electrode arranged to receive the data signal from one of the data lines via a first switching element (132); and a second sub-pixel area comprises a second sub-pixel electrode (34) electrically connected to a second capacitor (ClcB), the second sub-pixel electrode arranged to receive the data signal from said one of the data lines via a second switching element (134).

The method comprises the steps of:

connecting a first end of a third capacitor (CstB) to the second sub-pixel electrode (34) and a second end of the third capacitor to said one of the data lines via a third switching element, wherein each of the first, second and third switching elements comprises a control end arranged to receive a first gate line signal for switching;

charging the first capacitor (ClcA, CstA) to a first voltage level (Va) through the first switching element and charging the second capacitor (ClcB) to a second voltage level (Vb) through the second switching element in response to the first gate-line signal; and operatively connecting the second end of the third capacitor to a circuit element so as to transfer part of electrical charge on the second capacitor to the third capacitor when the first gate-line signal has at least partially passed.

In one embodiment of the present invention (FIG. 8), one end of the first and second capacitors is connected to a common voltage (COM), and the circuit element comprises a fourth switching element (138) having a control end arranged to receive a second gate-line signal for connecting the second end of the third capacitor (CstB) to the common voltage after the first gate-line signal has passed.

In another embodiment of the present invention (FIG. 5), the method further comprises:

connecting a fourth capacitor (Cx) between the second end of the third capacitor (CstB) and the common voltage (COM).

In yet another embodiment of the present invention (FIG. 11), the method further comprises:

connecting a fifth capacitor (CstB) to the second capacitor (ClcB) in parallel.

In a different embodiment of the present invention (FIG. 9), one end of the first and second capacitors is connected to a common voltage (COM), and the circuit element comprises a resistor (R) connected to the common voltage.

In another embodiment of the present invention (FIG. 12*b*), one end of the first and second capacitors is connected to a common voltage (COM), and the circuit element comprises a sixth capacitor (Cs) connected to the common voltage via a fourth switching element (138) having a control end arranged to receive a second gate-line signal for connecting the second end of the third capacitor (CstB) to the common voltage via the sixth capacitor (Cs) after the first gate-line signal has partially passed.

In yet another embodiment of the present invention (FIG. 12*a*), one end of the first and second capacitors is connected to a common voltage (COM), the second end of the third capacitor (CstB) is connected to the third switching element (136) via a sixth capacitor (Cs) and the circuit element comprises a fourth switching element (138) having a control end arranged to receive a second gate-line signal for connecting the second end of the third capacitor (CstB) to the common voltage after the first gate-line signal has partially passed.

The present invention will become apparent upon reading the description taken in conjunction with FIGS. 4 to 13.

BRIEF DESCRIPTION OF THE DRAWINGS

FIG. 7*a* shows an equivalent circuit of the pixel or color sub-pixel of FIG. 5, when the gate-line signal is on.

FIG. 7*b* shows an equivalent circuit of the pixel or color sub-pixel of FIG. 5, when the next gate-line signal is on.

DETAILED DESCRIPTION OF THE INVENTION

Figure 4:
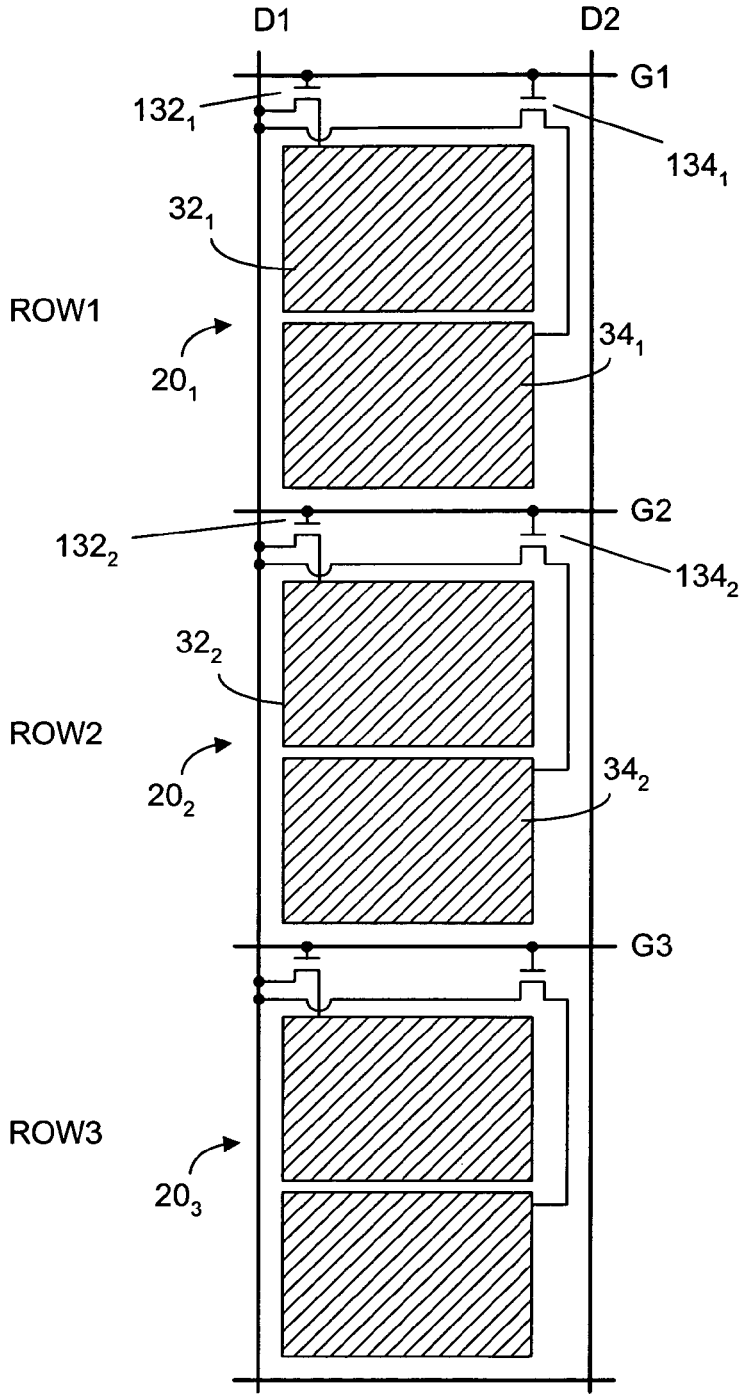
FIG. 4 shows the sub-pixel electrodes in a pixel or color sub-pixel in an LCD panel, according to one embodiment of the present invention.

In various embodiments of the present invention, a pixel or color sub-pixel of a liquid crystal display (LCD) panel comprises two areas, each area comprising an area electrode, together with a common electrode, for controlling the alignment of the liquid crystal layer in the respective area. For simplicity, the term sub-pixel will be used to represent a pixel or a color sub-pixel. As shown in FIG. 4, the sub-pixel $\mathbf{20}_1$ includes a first sub-pixel electrode $\mathbf{32}_1$ to define a first sub-pixel area and a second sub-pixel electrode $\mathbf{34}_1$ to define a second sub-pixel area. The sub-pixel $\mathbf{20}_2$ includes a first sub-pixel electrode $\mathbf{32}_2$ to define a first sub-pixel area and a second sub-pixel electrode $\mathbf{34}_2$ to define a second sub-pixel area. The sub-pixel $\mathbf{20}_3$ and other sub-pixels may have similar first and second sub-pixel electrodes. The sub-pixels in a column share a data line, and the sub-pixels in a row share a gate line. As shown in FIG. 4, the sub-pixels $\mathbf{20}_1$, $\mathbf{20}_2$, $\mathbf{20}_3$, . . . share a data line D1, and the sub-pixels in the next column (not shown) share a different data line D2. The sub-pixel $\mathbf{20}_1$ and other sub-pixels on the same row share a gate line G1; the sub-pixel $\mathbf{20}_2$ and other sub-pixels on the same row share a gate line G2; and the sub-pixel $\mathbf{20}_3$ and other sub-pixels on the same row share a gate line G3.

The first sub-pixel electrode $\mathbf{32}_1$ of the sub-pixel $\mathbf{20}_1$ is connected to the data line D1 through a first switching element $\mathbf{132}_1$ and the second sub-pixel electrode $\mathbf{34}_1$ is connected to the data line D1 through a second switching element $\mathbf{134}_1$. The control end of the first and second switching elements $\mathbf{132}_1$ and $\mathbf{134}_1$ is connected to the gate line G1. The first sub-pixel electrode $\mathbf{32}_2$ of the sub-pixel $\mathbf{20}_2$ is connected to the data line D1 through a first switching element $\mathbf{132}_2$ and the second sub-pixel electrode $\mathbf{34}_2$ is connected to the data line D1 through a second switching element $\mathbf{134}_2$. The control end of the first and second switching elements $\mathbf{132}_2$ and $\mathbf{134}_2$ is connected to the gate line G2.

Figure 1:
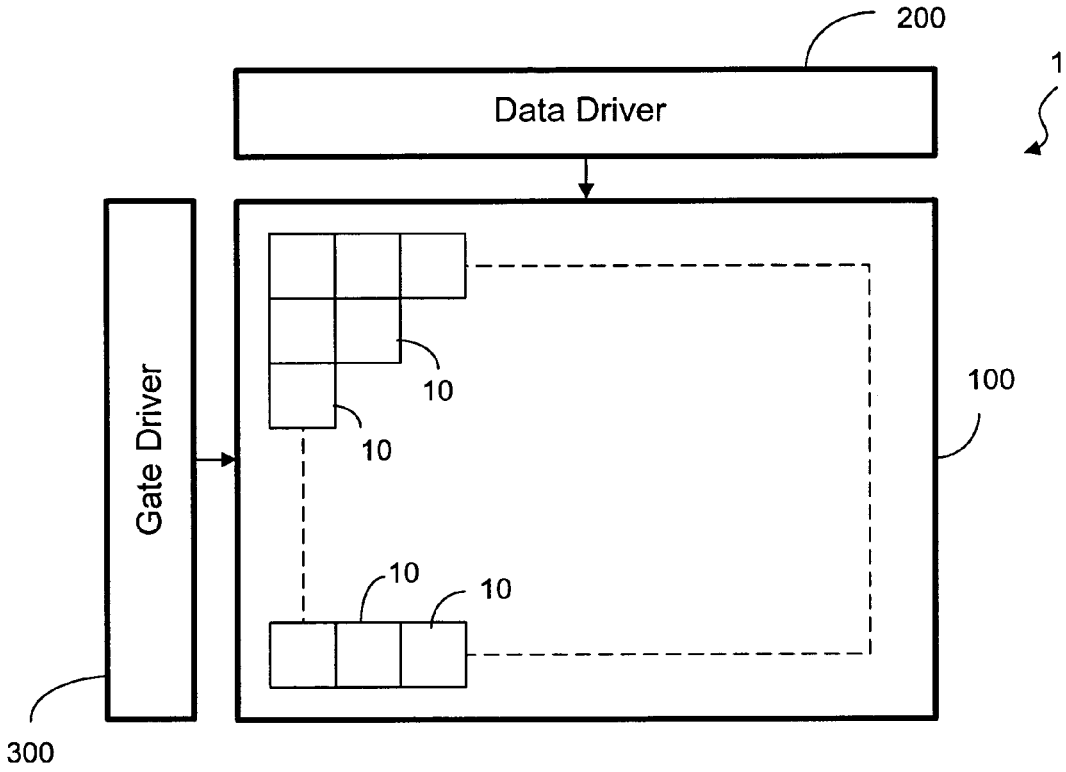
FIG. 1 (prior art)
FIG. 1 shows a typical LCD panel.
Figure 2:
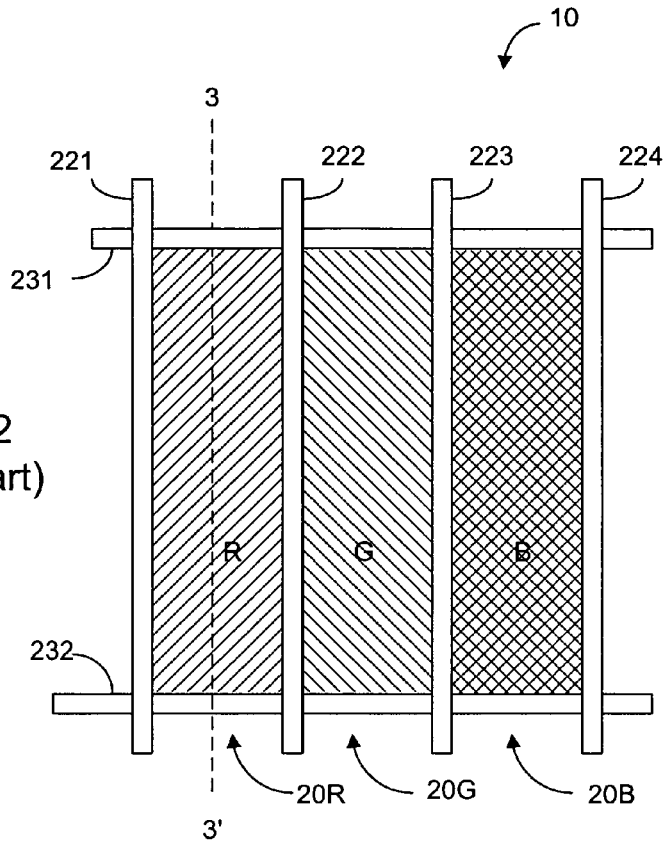
FIG.2 (prior art)
FIG. 2 shows three color sub-pixels in a pixel in a typical LCD panel.
Figure 3:
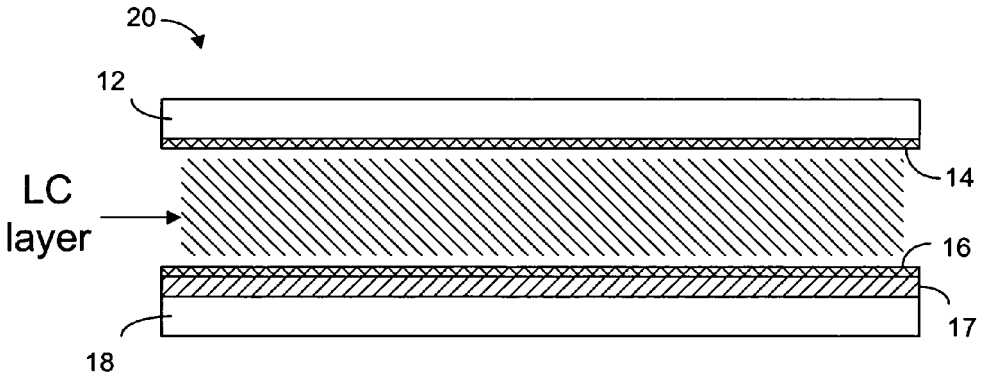
FIG.3 (prior art)
FIG. 3 shows a cross sectional view of a pixel or color sub-pixel in a typical LCD panel.
Figure 5:
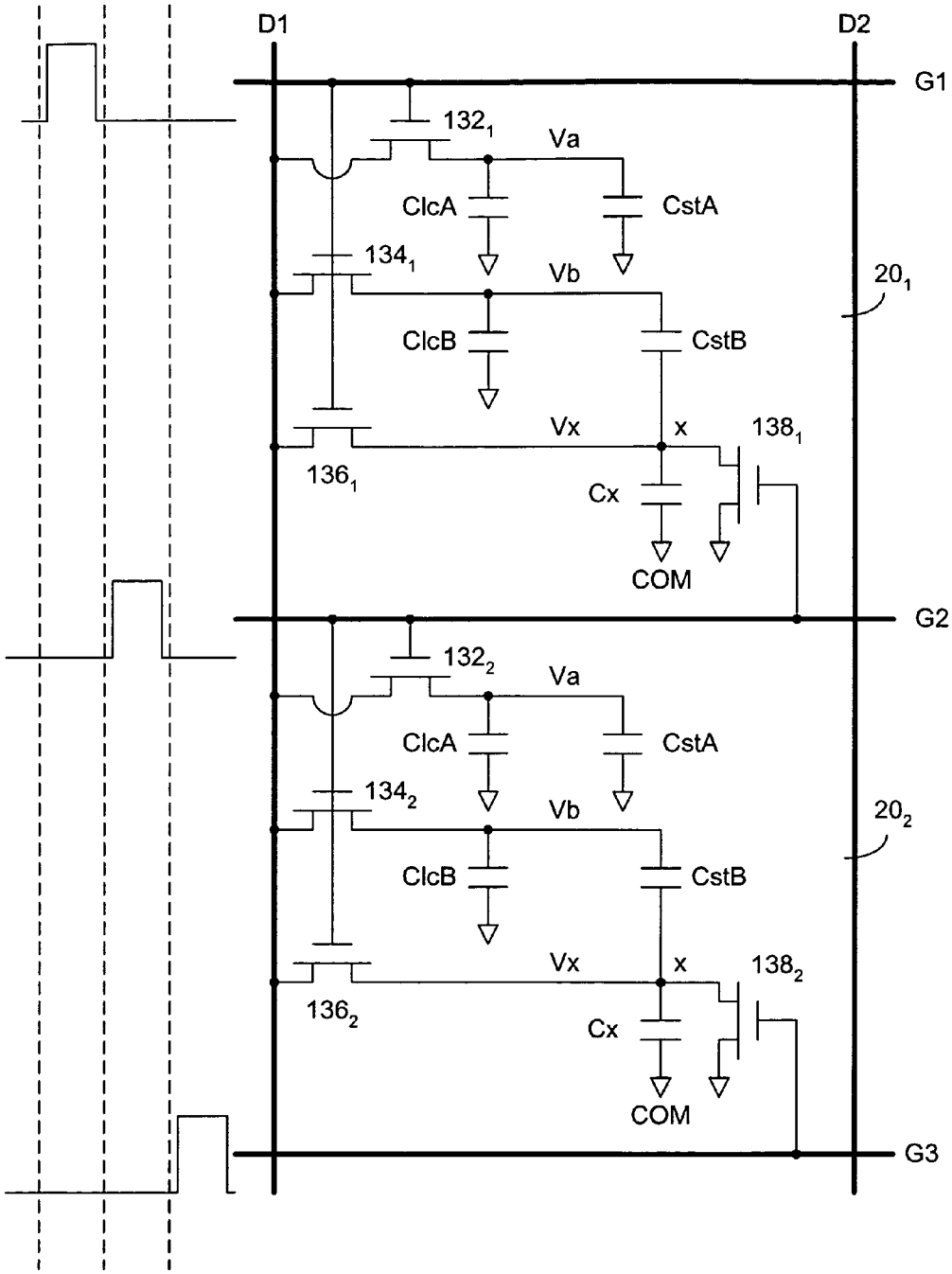
FIG. 5 shows an equivalent circuit of the pixel or color sub-pixel, according to one embodiment of the present invention.

The first sub-pixel electrode $\mathbf{32}_1$ and the common electrode (COM, see FIG. 3) form a capacitor ClcA and the second sub-pixel electrode $\mathbf{34}_1$ and the common electrode form a capacitor ClcB, as shown in FIG. 5. Furthermore, the first sub-pixel electrode $\mathbf{32}_1$ is connected to a storage capacitor CstA and the second sub-pixel electrode $\mathbf{34}_1$ is connected to a storage capacitor CstB. Likewise, the first sub-pixel electrode $\mathbf{32}_2$ and the common electrode form a capacitor ClcA and the second sub-pixel electrode $\mathbf{34}_2$ and the common electrode form a capacitor ClcB. The first sub-pixel electrode $\mathbf{32}_2$ is connected to a storage capacitor CstA and the second sub-pixel electrode $\mathbf{34}_2$ is connected to a storage capacitor CstB. The charge storage capacitor CstB is also connected to the data line D1 via a third switching element $\mathbf{136}_1$. The control end of the third switching element $\mathbf{136}_1$ is also connected to the gate line G1.

When the gate-line signal on G1 is provided to the sub-pixel 20.sub.1, the voltage level Va on the first sub-pixel electrode, the voltage level Vb on the second sub-pixel electrode and the voltage level Vx are substantially the same. The capacitors ClcA, CstA in the first sub-pixel area are charged according to the voltage level Va relative to COM. The capacitor ClcB in the second sub-pixel is charged according to the voltage level Vb relative to COM. Because the voltage level Vb on one end of the storage capacitor CstB and the voltage level Vx on the other end are substantially the same, the storage capacitor CstB is not charged.

When the gate line signal is completely passed, a circuit element in the pixel causes the voltage potential on the storage capacitor CstB to increase. As such, the charge in the capacitor ClcB is partly transferred to the storage capacitor CstB and the voltage level Vb is reduced accordingly. In the embodiment as shown in FIG. 5, the second charge-storage capacitor CstB is connected to COM separately via a capacitor Cx and via a fourth switching element $\mathbf{138}_1$ which has a control end connected to a second gate-line G2 for discharging purposes, due to the change in the voltage level Vx between the second charge-storage capacitor CstB and capacitor Cx.

Figure 6:
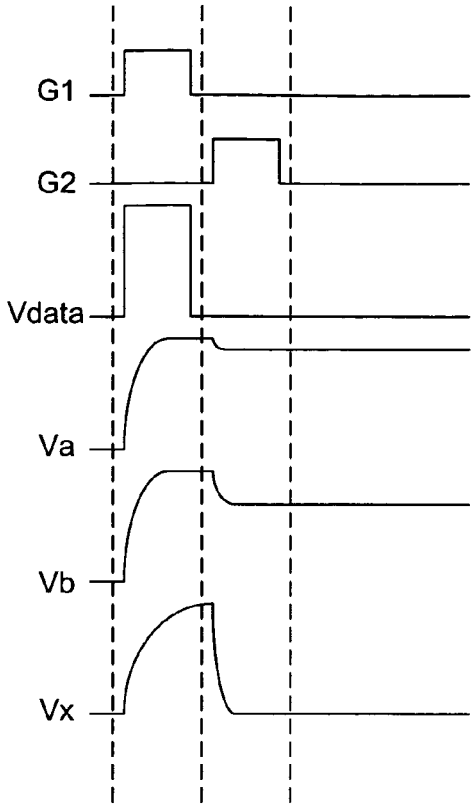
FIG. 6 is a timing chart showing various signals and voltages in the pixel as shown in FIG. 5.
Figure 7A:
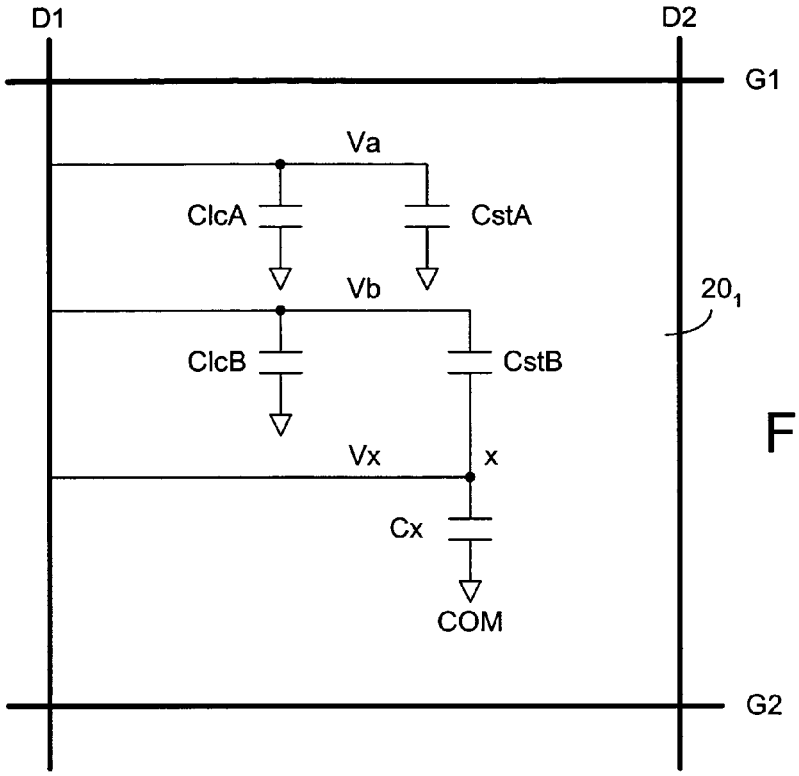

FIG. 6 is a timing chart showing the voltage level Va, the voltage level Vb and the voltage level Vx, in relation to the gate-line signals in G1 and G2. As shown in FIG. 6, the voltage level Vb is reduced when the gate-line signal G2 is provided to the pixel. The amount of voltage reduction in Vb is determined by the charge amount transferred to the storage capacitor CstB. When the gate-line signal G1 is provided to the sub-pixel $\mathbf{20}_1$, all the first, second and third switching elements are in a conducting state. The equivalent circuit in this situation is illustrated in FIG. 7*a*. After the charging of the capacitors in the sub-pixel $\mathbf{20}_1$ is substantially completed, the voltage levels Va, Vb and Vx is substantially equal to Vdata or the date signal on D1. There is substantially no charge in the charge-storage capacitor CstB because the voltage differential between its two capacitor ends is substantially zero. The charge in the capacitor ClcB is equal to qB, and we have:

$$Va=Vb=Vx=V\text{data} \tag{1}$$

$$qB=Vb*ClcB=V\text{data}*ClcB \tag{2}$$

Figure 7B:
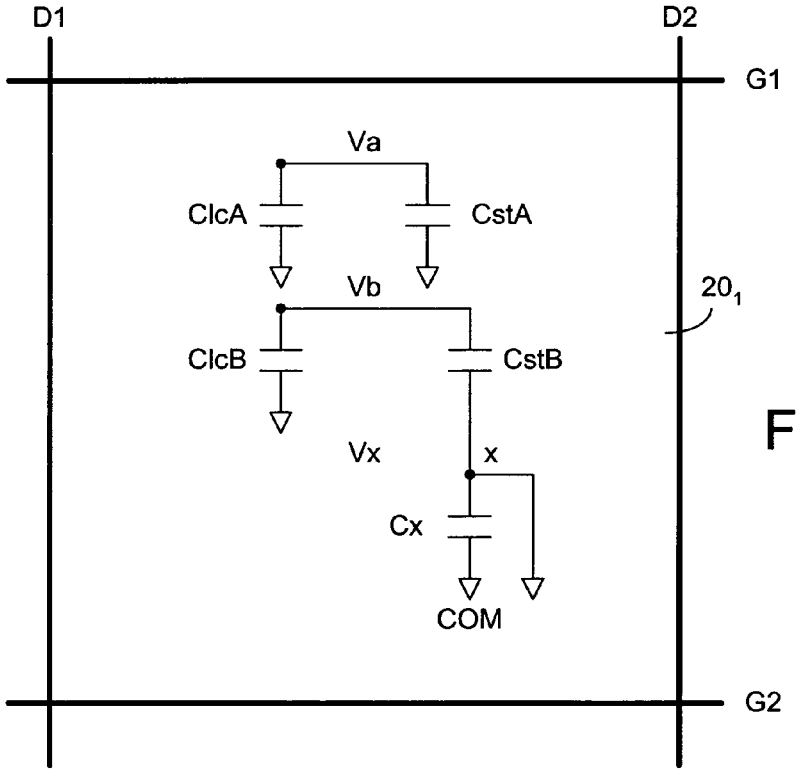

When the gate-line signal G2 is provided to the sub-pixel $\mathbf{20}_1$ and the gate-line signal G1 has passed, the first, second and third switching elements are in a non-conducting state and the fourth switching element is in a conducting state. The equivalent circuit in this situation is illustrated in FIG. 7*b*. While the voltage level Va is substantially unchanged, the voltage level Vb is reduced. As the voltage level Vx has changed from Vdata to COM, some of the charge qB in ClcB is transferred to CstB. When the charge transfer is completed, we have $$Va=V\text{data} \tag{3}$$

$$Vb=qB/(ClcB+CstB)=V\text{data}*ClcB/(ClcB+CstB)<V\text{data}<Va \tag{4}$$

Figure 8:
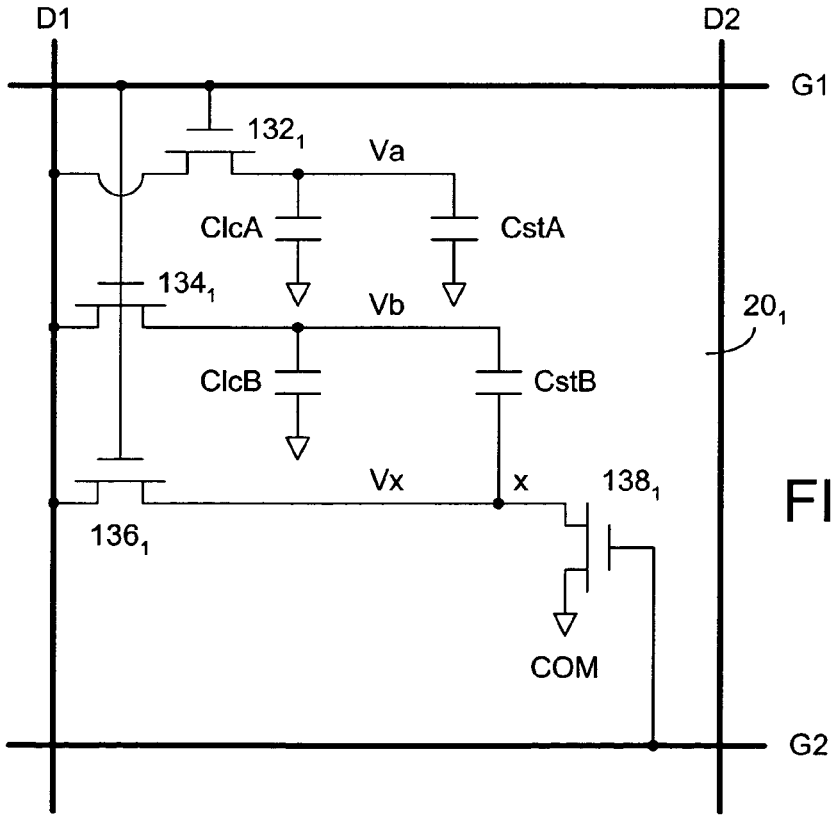
FIG. 8 shows an equivalent circuit of the pixel or color sub-pixel, according to another embodiment of the present invention.

Thus, the voltage level in the sub-pixel electrode in the first sub-pixel area is higher than the voltage level in the sub-pixel electrode in the second sub-pixel area. As such, the brightness of the second sub-pixel area is generally lower than the brightness of the first sub-pixel area, FIG. 8 shows another embodiment of the present invention, wherein the capacitor Cx is omitted. With the embodiment as shown in FIG. 8, the voltage levels Va and Vb are substantially the same as those shown in FIG. 6. The voltage level Vx may rise more rapidly as compared to that shown in FIG. 6.

Figure 9:
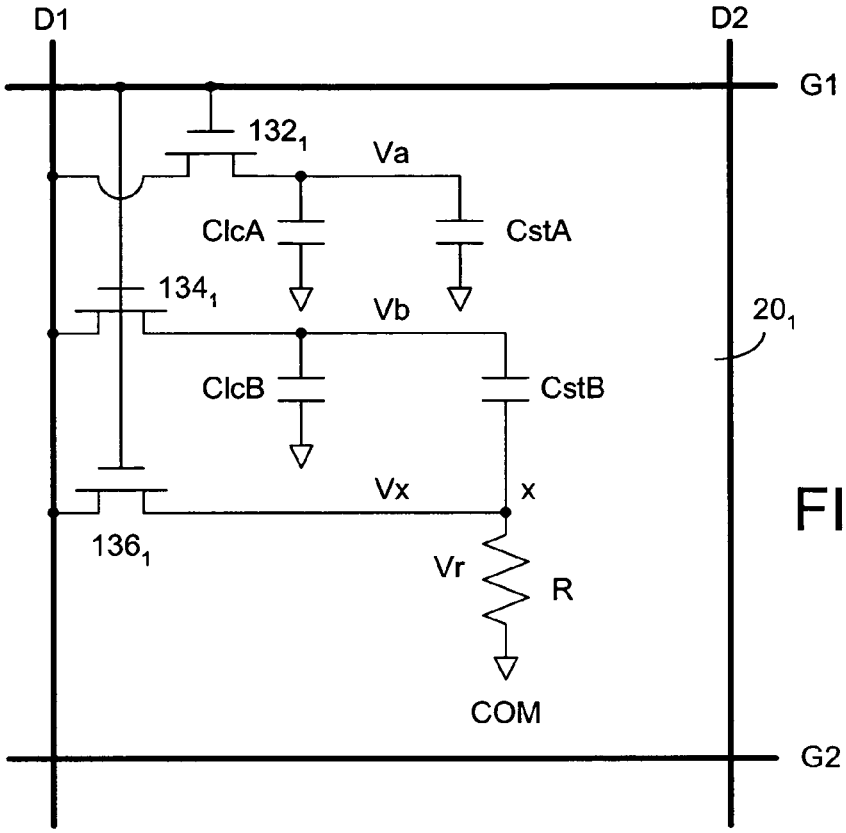
FIG. 9 shows an equivalent circuit of the pixel or color sub-pixel, according to yet another embodiment of the present invention.

FIG. 9 shows yet another embodiment of the present invention, which is a variation from the embodiment as shown in FIG. 8. Instead of using the circuit element $\mathbf{138}_1$ for controlling the charge transfer from ClcB to CstB, a resistor R is used. In the embodiment as shown in FIG. 9, when the gate-line signal G1 is on, we have $$Va=Vb=V\text{data}>Vx=V\text{com}+Vr \tag{5}$$

and there is a current through the resistor R. When the gate-line signal G1 has passed, the current through R is diminishing or Vr=0. Finally the voltage level at point x is equal to COM, regardless of the gate-line signal G2. We then have $$Vb=qB/(ClcB+CstB)=[V\text{data}*ClcB+(V\text{data}-Vx)*CstB]/(ClcB+CstB)=V\text{data}-[Vx*CstB/(ClcB+CstB)] \tag{6}$$

Figure 10:
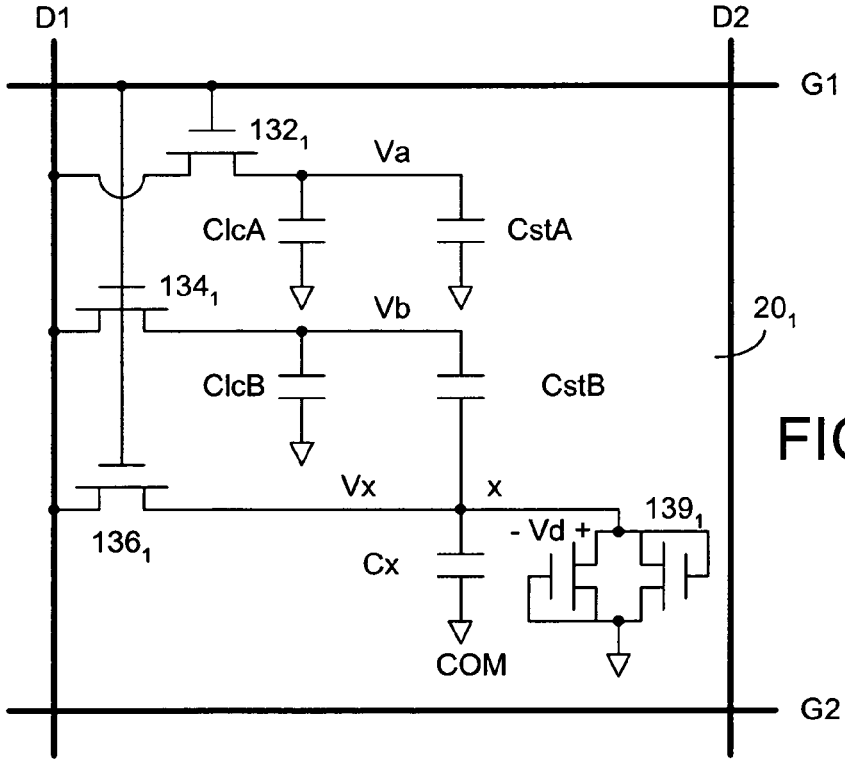
FIG. 10 shows an equivalent circuit of the pixel or color sub-pixel, according to still another embodiment of the present invention.

FIG. 10 shows yet another embodiment of the present invention, which is a variation of the embodiment as shown in FIG. 5. Instead of using the circuit element $\mathbf{138}_1$ for controlling the charge transfer from ClcB to CstB, a circuit element $\mathbf{139}_1$ is used. In the embodiment as shown in FIG. 10, when the gate-line signal G1 is on, we have $$Va=Vb=V\text{data}>Vx \tag{7}$$

and there is a current through the circuit element $\mathbf{139}_1$. When the gate-line signal G1 has passed, the current through the circuit element $\mathbf{139}_1$ is diminishing. Finally the voltage level at point x is equal to COM, regardless of the gate-line signal G2. We then have $$Vb=qB/(ClcB+CstB)=[V\text{data}*ClcB+(V\text{data}-Vx)*CstB]/(ClcB+CstB)=V\text{data}-[Vx*CctB/(ClcB+CstB)] \tag{8}$$

Thus, in the embodiments as shown in FIGS. 9 and 10, when the gate-line signal G1 has passed, while Va is still substantially equal to Vdata, Vb is smaller than Vdata due to the fact that the resistor R (FIG. 9) or the TFT with a diode connection 139 (FIG. 10) causes the capacitor associated with the second sub-pixel electrode to transfer its charge to another capacitor, resulting in a reduction of the voltage level on the second sub-pixel electrode. As such, the alignment of the liquid crystal molecules in the first sub-pixel area is slightly different from the alignment of the liquid crystal molecules in the second sub-pixel area, resulting in a slight brightness difference between the first and the second sub-pixel areas. This brightness difference may reduce the color shift of the liquid crystal display panel.

It should be noted that, in the embodiment as shown in FIG. 10, the capacitor Cx is optional.

Figure 11:
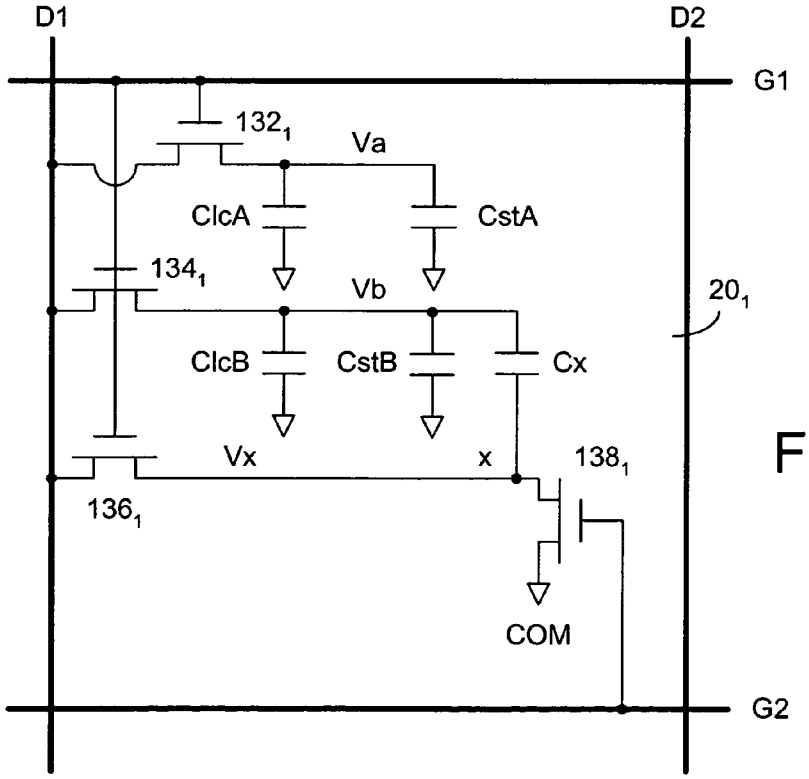
FIG. 11 shows an equivalent circuit of the pixel or color sub-pixel, according to a different embodiment of the present invention.

FIG. 11 shows a variation of the embodiment as shown in FIGS. 5 and 8. As shown in FIG. 11, the first sub-pixel area has a first sub-pixel electrode connected to a first storage capacitor CstA and the second sub-pixel area has a second sub-pixel electrode connected to a second storage capacitor CstB. Additionally, the second sub-pixel electrode is connected to a circuit element $\mathbf{138}_1$ through a capacitor Cx. When the gate-line signal G1 is on, we have $$Va=Vb=Vx=V\text{data}, \tag{9}$$

and the charge on the capacitor ClcB and CstB is $$qB=Vb*(ClcB+CstB)=V\text{data}*(ClcB+CstB) \tag{10}$$

When the gate-line signal G2 is provided to the sub-pixel $\mathbf{20}_1$ and the gate-line signal G1 has passed, we have $$Va=V\text{data} \tag{11}$$

$$Vb=qB/(ClcB+CstB+Cx)=V\text{data}*(ClcB+CstB)/(ClcB+CstB+Cx)>V\text{data}<Va \tag{12}$$

Figure 13:
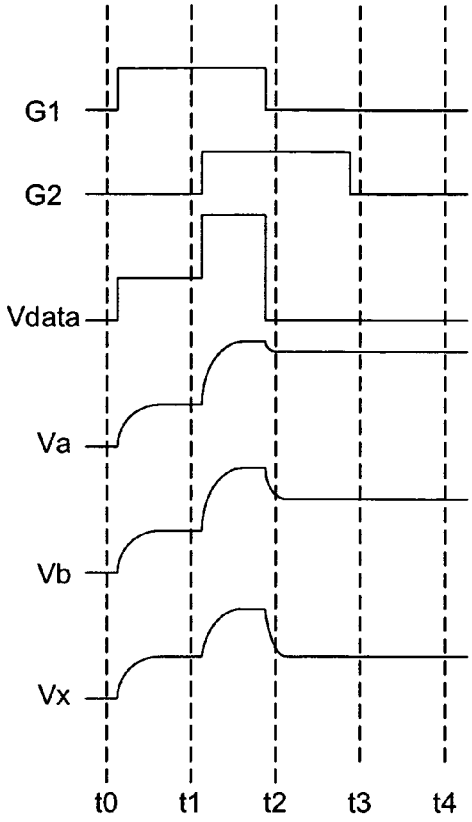
FIG. 13 is a timing chart showing various signals and voltages in the pixel as shown in FIGS. 12*a* and 12*b*.

It should be noted that, in the embodiments as shown in FIGS. 5, 8-11, the gate-line signals G1 and G2 can be non-overlapping, as shown in FIG. 6. In a display panel where pre-charging of pixels is carried out, the gate-line signal Gm+1 partially occurs before the gate-line Gm has passed in order to pre-charge the pixels in the $(m+1)^{th}$ row. This requires the gate-line signals in adjacent gate-lines to be partially over-lapped, as shown in FIG. 13. The embodiments as shown in FIGS. 9 and 10 can be used when the gate-lines signals have an over-lapped period. But in the embodiments wherein the next gate-line signal is used to control the charge transfer, as shown in FIGS. 5, 8 and 11, a capacitor Cx is used to separate point x from the switching element $\mathbf{136}_i$ when the gate-lines signals have an overlapped period.

Figure 12A:
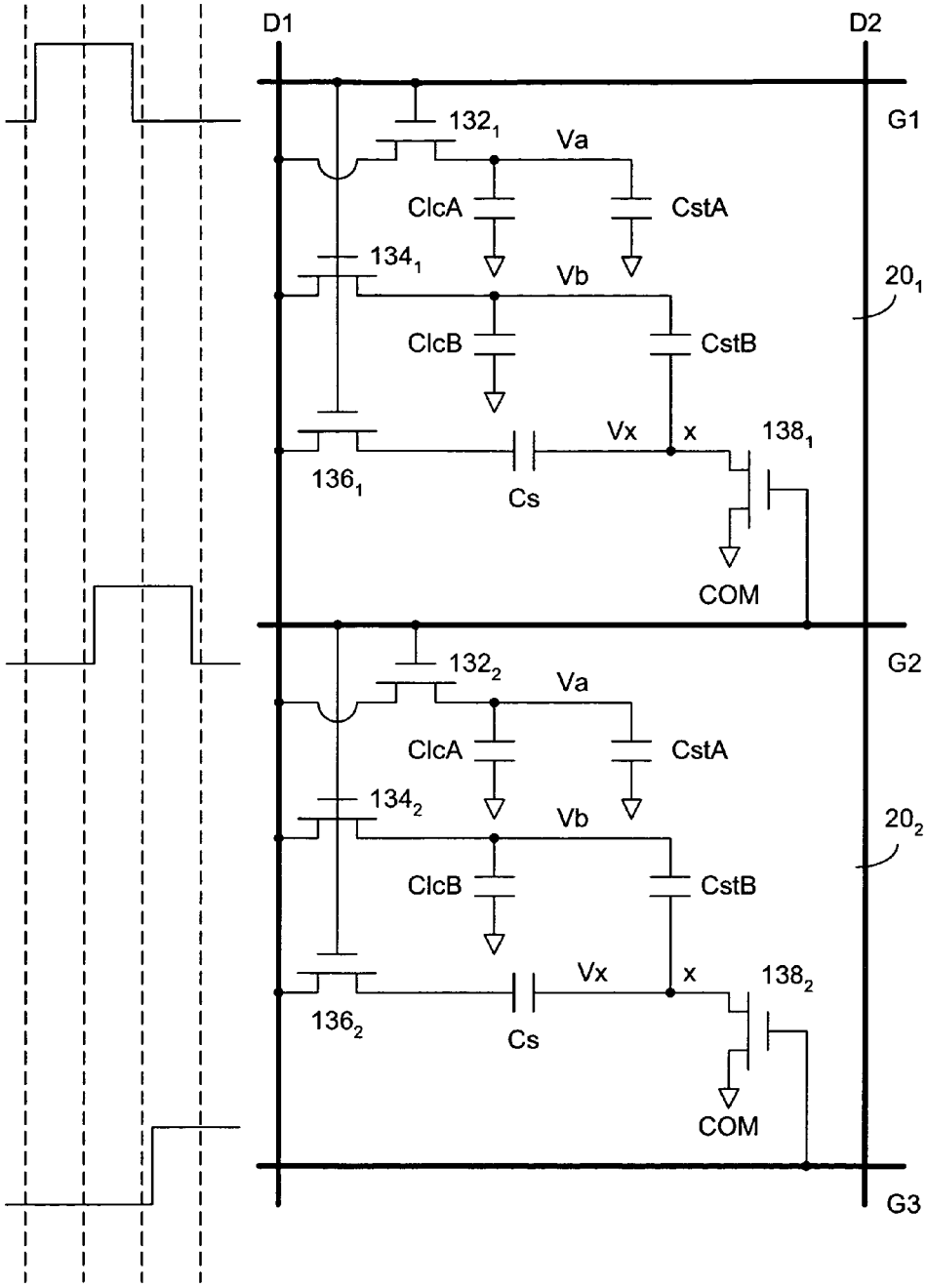
FIGS. 12*a* and 12*b* show an equivalent circuit of the pixel or color sub-pixel, according to another different embodiment of the present invention.
Figure 12B:
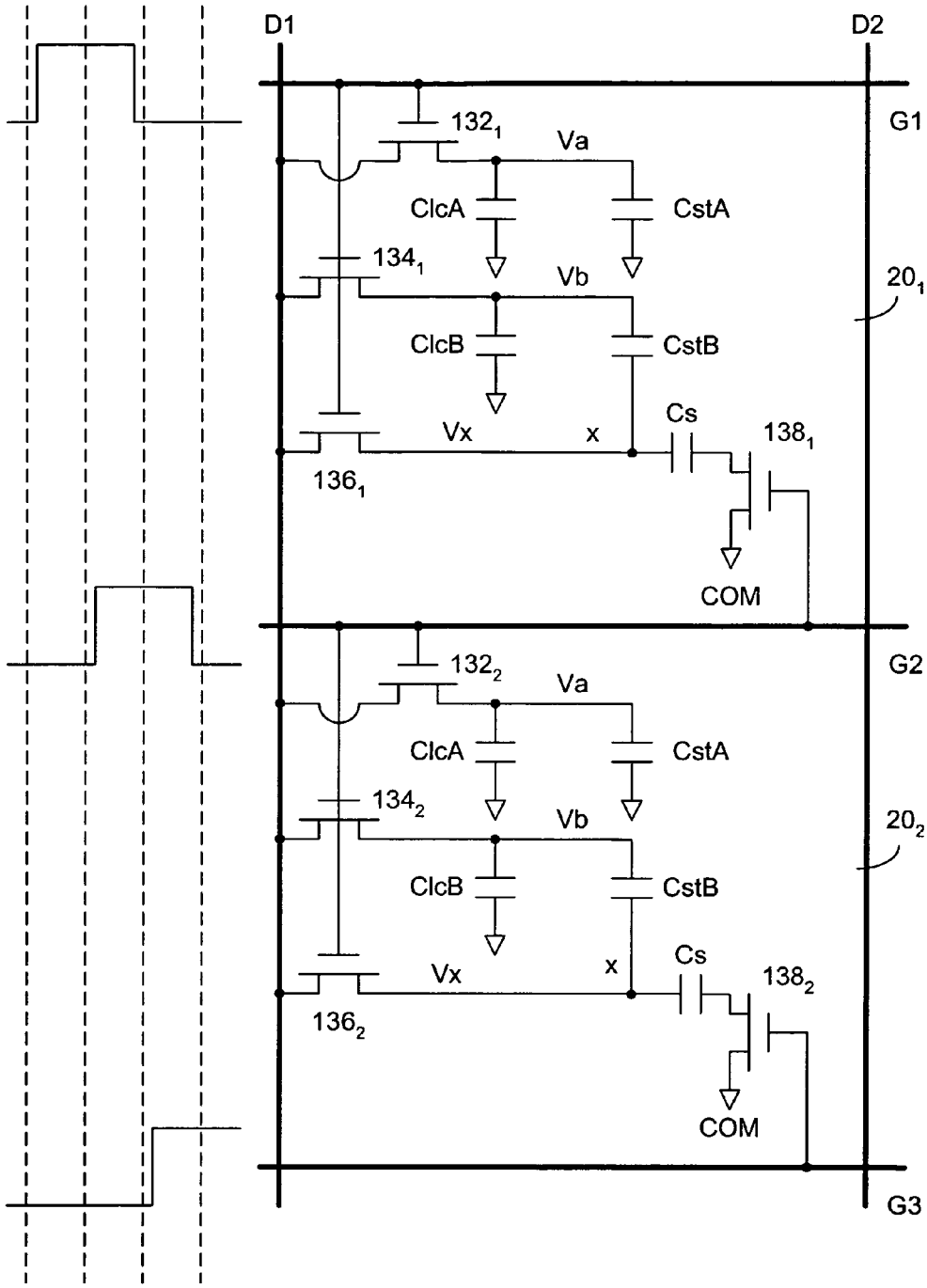

FIG. 12 shows one of the different embodiments that can be used pre-charging purposes. As shown in FIG. 12, the switching element $\mathbf{136}_i$ is connected to the circuit element $\mathbf{138}_i$ through a capacitor Cx. The timing chart illustrating various voltage levels is shown in FIG. 13.

In summary, in a liquid crystal display panel according to various embodiments of the present invention, each pixel has a first sub-pixel area comprising a first sub-pixel electrode electrically connected to a first capacitor (ClcA, CstA), the first sub-pixel electrode (where Va is) arranged to receive the data signal (G1) from one of the data lines via a first switching element (132); and a second sub-pixel area comprises a second sub-pixel electrode (where Vb is) electrically connected to a second capacitor and a first end of a third capacitor. In the embodiments as shown in FIGS. 5, 8, 9, 10, 12*a* and 12*b*, the second capacitor is ClcB and the third capacitor is CstB. In the embodiment as shown in FIG. 11, the second capacitor includes ClcB and CstB and the third capacitor is Cx. The second sub-pixel electrode arranged to receive said data signal from the same data line via a second switching element (134), wherein a second end of the third capacitor is connected to the same data line via a third switching element (136), wherein each of the first, second and third switching elements comprises a control end (gate terminal) arranged to receive a gate-line signal (G1) for charging the first capacitor and the second capacitor, and wherein the second end of the third capacitor is connected to a circuit element (138, R, 139) such that when the gate-line signal has at least partially passed, the circuit element causes part of electrical charge on the second capacitor to transfer to the third capacitor. The circuit element may have a fourth switching element (138) arranged to receive a second gate-line signal (G2) for connecting the second end of the third capacitor to the common voltage after the first gate-line signal has passed.

In a different aspect, the present invention provide a method to achieve a voltage difference between the first sub-pixel electrode and the second sub-pixel electrode in some time periods during the operation of the liquid crystal display panel. The method includes the steps of connecting a first end of a third capacitor to the second sub-pixel electrode and a second end of the third capacitor to said one of the data lines via a third switching element, wherein each of the first, second and third switching elements comprises a control end arranged to receive a first gate line signal for switching; charging the first capacitor to a first voltage level through the first switching element and charging the second capacitor to a second voltage level through the second switching element in response to the first gate-line signal; and operatively connecting the second end of the third capacitor to a circuit element for transferring part of electrical charge on the second capacitor to the third capacitor when the first gate-line signal has at least partially passed so as to reduce the second voltage level.

Although the present invention has been described with respect to one or more embodiments thereof, it will be understood by those skilled in the art that the foregoing and various other changes, omissions and deviations in the form and detail thereof may be made without departing from the scope of this invention.

What is claimed is:

1. A liquid crystal display panel, comprising:

a plurality of pixels arranged in a plurality of rows and columns;

a plurality of data lines, each for providing date signals to the pixels in a column, and a plurality of gate-lines, each for proving gate-line signals to the pixels in a row, wherein each of some or all of the pixels comprises:

a first sub-pixel area comprising a first sub-pixel electrode electrically connected to a first capacitor, the first sub-pixel electrode arranged to receive the data signal from one of the data lines via a first switching element; and a second sub-pixel area comprises a second sub-pixel electrode electrically connected to a second capacitor and a first end of a third capacitor, the second sub-pixel electrode and the first end of the third capacitor arranged to receive said data signal from said one of the data lines via a second switching element, wherein a second end of the third capacitor is arranged to receive the data signal from said one of the data lines via a third switching element, wherein each of the first, second and third switching elements comprises a control end arranged to receive a first gate-line signal for charging the first capacitor and the second capacitor, and wherein the second end of the third capacitor is connected to a circuit element such that when the first gate-line signal has passed, the circuit element causes part of electrical charge on the second capacitor to transfer to the third capacitor.

2. The liquid crystal display panel according to claim 1, wherein one end of the first and second capacitors is connected to a common voltage, and the circuit element comprises a fourth switching element having a control end arranged to receive a second gate-line signal for connecting the second end of the third capacitor to the common voltage after the first gate-line signal has passed.

3. The liquid crystal display panel according to claim 2, wherein the second end of the third capacitor is also connected to the common voltage via a fourth capacitor.

4. The liquid crystal display panel according to claim 1, wherein the second capacitor is connected to a fourth capacitor in parallel.

5. The liquid crystal display panel according to claim 1, wherein one end of the first and second capacitors is connected to a common voltage and the circuit element comprises a resistor connected to the common voltage.

6. The liquid crystal display panel according to claim 1, wherein one end of the first and second capacitors is connected to a common voltage and the circuit element comprises a transistor with a diode connection, one end of the circuit element connected to the common voltage.

7. The liquid crystal display panel according to claim 1, wherein one end of the first and second capacitors is connected to a common voltage, and the circuit element comprises a fourth capacitor connected to the common voltage via a fourth switching element, the fourth switching element comprising a control end arranged to receive a second gate-line signal for connecting the second end of the third capacitor to the common voltage via the fourth capacitor after the first gate-line signal has passed.

8. The liquid crystal display panel according to claim 1, wherein one end of the first and second capacitors is connected to a common voltage, the second end of the third capacitor is connected to the third switching element via a fourth capacitor and the circuit element comprises a fourth switching element having a control end arranged to receive a second gate-line signal for connecting the second end of the third capacitor to the common voltage after the first gate-line signal has passed.

9. A method of charge sharing in a liquid crystal display panel, the display panel comprising:

a plurality of pixels arranged in a plurality of rows and columns;

a plurality of data lines, each for providing date signals to the pixels in a column, and a plurality of gate-lines, each for proving gate-line signals to the pixels in a row, wherein each of some or all of the pixels comprises:

a first sub-pixel area comprising a first sub-pixel electrode electrically connected to a first capacitor, the first sub-pixel electrode arranged to receive the data signal from one of the data lines via a first switching element; and a second sub-pixel area comprises a second sub-pixel electrode electrically connected to a second capacitor, the second sub-pixel electrode arranged to receive the data signal from said one of the data lines via a second switching element, said method comprising:

connecting a first end of a third capacitor to the second sub-pixel electrode and arranging a second end of the third capacitor to receive the data signal from said one of the data lines via a third switching element and the first end of the third capacitor to receive the data signal from said one of the data lines via the second switching element, wherein each of the first, second and third switching elements comprises a control end arranged to receive a first gate line signal for switching;

charging the first capacitor to a first voltage level through the first switching element and charging the second capacitor to a second voltage level through the second switching element in response to the first gate-line signal; and operatively connecting the second end of the third capacitor to a circuit element for transferring part of electrical charge on the second capacitor to the third capacitor when the first gate-line signal has passed so as to reduce the second voltage level.

10. The method according to claim 9, wherein one end of the first and second capacitors is connected to a common voltage, and the circuit element comprises a fourth switching element having a control end arranged to receive a second gate-line signal for connecting the second end of the third capacitor to the common voltage after the first gate-line signal has passed.

11. The method according to claim 10, further comprising:

connecting a fourth capacitor between the second end of the third capacitor and the common voltage.

12. The method according to claim 9, further comprising:

connecting a fourth capacitor to the second capacitor in parallel.

13. The method according to claim 9, wherein one end of the first and second capacitors is connected to a common voltage and the circuit element comprises a resistor connected to the common voltage.

14. The method according to claim 9, wherein one end of the first and second capacitors is connected to a common voltage, and the circuit element comprises a fourth capacitor connected to the common voltage via a fourth switching element, the fourth switching element comprising a control end arranged to receive a second gate-line signal for connecting the second end of the third capacitor to the common voltage via the fourth capacitor after the first gate-line signal has passed.

15. The method according to claim 9, wherein one end of the first and second capacitors is connected to a common voltage, the second end of the third capacitor is connected to the third switching element via a fourth capacitor and the circuit element comprises a fourth switching element having a control end arranged to receive a second gate-line signal for connecting the second end of the third capacitor to the common voltage after the first gate-line signal has passed.

* * * * *